United States Patent [19]

Deguchi et al.

[11] Patent Number: 4,788,132

[45] Date of Patent: Nov. 29, 1988

[54] SILVER HALIDE COLOR REVERSAL PHOTOGRAPHIC MATERIAL

[75] Inventors: Naoyasu Deguchi; Tetsuro Kojima; Hideo Miyazaki; Shigeru Ohno; Koki Nakamura, all of Kanagawa, Japan

[73] Assignee: Fuji Photo Film Co., Ltd., Kanagawa, Japan

[21] Appl. No.: 884,169

[22] Filed: Jul. 10, 1986

[30] Foreign Application Priority Data

Jul. 10, 1985 [JP] Japan ..... 60-151863

[51] Int. Cl.[4] ..... G03C 5/50

[52] U.S. Cl. ..... 430/505; 430/379; 430/506; 430/564; 430/600; 430/611

[58] Field of Search ..... 430/505, 611, 600, 379, 430/564, 506

[56] References Cited

U.S. PATENT DOCUMENTS

| | | | |
|---|---|---|---|
| 3,554,756 | 1/1971 | Terashima et al. | 430/505 |
| 4,322,493 | 3/1982 | Shibaoka et al. | 430/379 X |
| 4,451,561 | 5/1984 | Hirabayashi et al. | 430/611 X |
| 4,543,309 | 9/1985 | Hirabayashi et al. | 430/611 X |
| 4,554,245 | 11/1985 | Hayashi et al. | 430/379 X |
| 4,626,498 | 2/1986 | Shuto et al. | 430/379 |

*Primary Examiner*—Mukund J. Shah

*Attorney, Agent, or Firm*—Sughrue, Mion, Zinn, Macpeak & Seas

[57] ABSTRACT

A silver halide color reversal photographic material is disclosed which comprises a support and at least one blue-sensitive silver halide emulsion layer, at least one green-sensitive silver halide emulsion layer and at least one red-sensitive silver halide emulsion layer on the support, which material is characterized in that at least one light-sensitive silver halide emulsion layer or at least one layer adjacent thereto contains at least one of the compounds represented by the following general formulae (I), (II), (III) and (IV):

General Formula (I)

General Formula (II)

General Formula (III)

General Formula (IV)

All the symbols used are as defined in the Specification.

10 Claims, No Drawings

SILVER HALIDE COLOR REVERSAL PHOTOGRAPHIC MATERIAL

BACKGROUND OF THE INVENTION

1. FIELD OF THE INVENTION

The present invention relates to a silver halide photographic material which shows increased interimage effects and has improved sharpness and granularity.

2. DESCRIPTION OF THE PRIOR ART

It is known that upon color development of a silver halide color photographic material, an oxidized aromatic primary amine-based color developing agent and a coupler react to form a dye such as indophenol, indoaniline, indamine, azomethine, phenoxazine and phenazine, thereby producing a color image. In such a system, color reproduction is usually carried out by a subtractive process; silver halide emulsions selectively sensitive to blue, green and red, and yellow, magenta and cyan color image-forming agents in a complementary color relation therewith are used. In the formation of a yellow color image, an acylacetanilide or a dibenzoylmethane-based coupler, for example, is mainly used. In the formation of a magenta color image, a pyrazolone, pyrazolobenzimidazole, pyrazolopyrazole, pyrazolotriazole, cyanoacetophenone or indazolone-based coupler is mainly used, and in the formation of a cyan color image, a phenol or naphthol-based coupler is mainly used.

Each dye formed from the above couplers does not have an ideal spectral absorption spectrum. In particular, magenta and cyan dyes have broad absorption spectra and have a sub-absorption in the short wavelength region, both factors being unsuitable for color reproduction of a color photographic material.

In particular, the sub-absorption in the short wavelength region tends to decrease saturation or chroma. One means to overcome the above problem is to use dyes which exhibit the interimage effect. A decrease in saturation can be improved to a certain extent by using dyes which exhibit the interimage effect.

This interimage effect is described in Hanson et al., *Journal of the Optical Society of America,* Vol. 42, pp. 663–669, A. Thiels, *Zeitschrift fur Wissenschaftliche Photographie, Photophysque und Photochemie,* Vol. 47, pp. 106–118 and pp. 246–255, and so forth.

U.S. Pat. No. 3,536,486 discloses a method in which the interimge effect is obtained by introducing a diffusible 4-thiazoline-2-thione into an exposed color reversal photographic element, and U.S. Pat. No. 3,536,487 discloses a method in which the interimage effect is obtained by introducing a diffusible 4-thiazoline-2-thione into an unexposed color reversal photographic element.

Japanese Patent Pulication No. 34169/73 describes that the interimage effect is markedly exhibited by allowing an N-substituted 4-thiazoline-2-thione compound to be present at the time of the reduction of silver halide into silver through development of a color photographic material.

Research Disclosure, No. 131, Clause 13116 (1975) discloses that a colloidal silver containing layer can be provided between a cyan layer and a magenta layer of a color reversal photographic element to obtain the interimage effect.

In addition, U.S. Pat. No. 4,082,553 discloses a method of obtaining the interimage effect where, in a color reversal light-sensitive material which has a layer arrangement that permits the transfer of iodine ions during development, latent image-forming silver haloiodide particles are incorporated in one layer of the material, and latent imageforming silver halide particles and silver halide particles, the surface of which is fogged so as to render the same capable of being developed regardless of image exposure are incorporated in another layer.

The above methods, however, fail to provide a sufficient interimage effect. Further, the use of a colloidal silver containing layer, the incorporation of fogged silver halide particles and so forth yield the serious disadvantage in a color reversal light-sensitive material that a reduction in color density is caused.

It is also known that the interimage effect can be obtained by using a coupler (DIR coupler) capable of releasing a development inhibiting substance (such as benzotriazole derivatives and mercapto compounds) during the coupling reaction with an oxidized product of a color developing agent at the color developing step, or by using hydroquinone compounds, for example, capable of releasing a development inhibiting substance such as iodide ions and mercapto compounds. Use of these compounds, however, is associated with serious desensitization, or causes a reduction in color density. Thus the compounds are limited in their practical use.

A DIR coupler exhibits the interimage effect by inhibiting development at color developing. However, even if a DIR coupler is applied to a color reversal lightsensitive material, color development is hardly inhibited and thus the interimage effect is not exhibited to any substantial extent.

SUMMARY OF THE INVENTION

An object of the present invention is to provide a color reversal photographic material which exhibits a high interimage effect without deteriorating other photographic characteristics.

Another object of the present invention is to provide a silver halide color reversal photographic material of excellent sharpness.

Still another object of the present invention is to provide a silver halide color reversal photographic material of excellent sharpness and further of good granularity.

It has been found that the above objects are attained by incorporating at least one of the compounds represented by the general formula (I), (II), (III) and (IV) as described hereinafter into at least one light-sensitive silver halide emulsion layer or in at least one layer adjacent thereto in a silver halide color reversal photographic material.

The present invention thus relates to a silver halide color reversal photographic material comprising a support and at least one blue-sensitive silver halide emulsion layer, at least one green-sensitive silver halide emulsion layer and at least one red-sensitive silver halide emulsion layer provided on the support, where at least one of the compounds represented by the general formulae (I), (II), (III) or (IV) is incorporated in at least one of the light-sensitive silver halide emulsion layers or in at least one layer adjacent thereto.

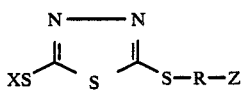

General Formula (I)

-continued

General Formula (II)

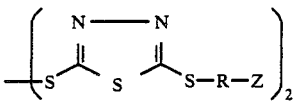

General Formula (III)

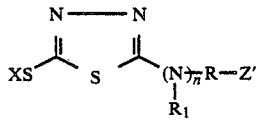

General Formula (IV)

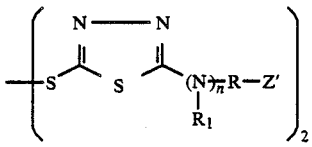

DETAILED DESCRIPTION OF THE INVENTION

General formulae (I), (II), (III) and (IV) are described below in detail.

In general formula (I), (II), (III) and (IV):

R represents a straight, branched or cyclic alkylene group, a straight or branched alkenylene group, a straight or branched aralkylene group, or an arylene group;

$R^1$ represents a hydrogen atom, a substituted or unsubstituted alkyl group, a substituted or unsubstituted alkenyl group, a substituted or unsubstituted aralkyl group, or a substituted or unsubstituted aryl group;

Z and Z' each represents a polar substituent;

X represents a hydrogen atom, a cation which renders the molecule neutral, or a precursor thereof; and n is 0 or 1.

More specifically, R preferably represents a straight, branched or cyclic alkylene group having 1 to 12 carbon atoms, preferably 1 to 6 carbon atoms (e.g., a methylene group, an ethylene group, a propylene group, a butylene group, a hexylene group, a 1-methylethylene group, and a 1,4-cyclohexylene group), a straight or branched alkenylene group having 2 to 12 carbon atoms, preferably having 2 to 6 carbon atoms (e.g., a vinylene group, and a 1-methylvinylene group), a straight or branched aralkylene group having 7 to 20 carbon atoms, preferably 7 to 15 carbon atoms (e.g., a benzylidene group), or an arylene group having 6 to 20 carbon atoms, preferably 6 to 15 carbon atoms (e.g., a phenylene group and a naphthylene group).

The polar substituent represented by Z and Z' includes a substituted or unsubstituted amino group having 1 to 12 carbon atoms, preferably 1 to 6 carbon atoms (including salts; e.g., amino group, an amino hydrochloride group, a methylamino group, a dimethylamino group, a dimethylamino hydrochloride group, a dibutylamino group, a dipropylamino group, and an N-dimethylaminoethyl-N-methylamino group), a quaternary ammoniumyl group having 3 to 18 carbon atoms, preferably 3 to 12 carbon atoms (e.g., a trimethylammoniumyl chloride group and a dimethylbenzylammoniumyl chloride group), an alkoxy group having 1 to 12 carbon atoms, preferably 1 to 6 carbon atoms (e.g., a methoxy group, an ethoxy group and a 2-hydroxyethoxy group), an aryloxy group having 6 to 20 carbon atoms, preferably 6 to 15 carbon atoms (e.g., a phenoxy group), an alkylthio group having 1 to 12 carbon atoms, preferably 1 to 6 carbon atoms (e.g., a methylthio group and a butylthio group), an arylthio group having 6 to 20 carbon atoms, preferably 6 to 15 carbon atoms (e.g., a phenylthio group), a 5- to 7-membered heterocyclic oxy group containing 1 to 12 carbon atoms, preferably 1 to 6 carbon atoms, and one or more of N, O and S as hetero atoms (e.g., a 2-pyridyloxy group and a 2-imidazolyloxy group), a 5- to 7-membered heterocyclic thio group containing 1 to 12 carbon atoms, preferably 1 to 6 carbon atoms, and one or more of N, O and S as hetero atoms (e.g., a 2-benzothiazolylthio group and a 4-pyrazolythio group), a sulfonyl group having 1 to 12 carbon atoms, preferably 1 to 6 carbon atoms (e.g., a methanesulfonyl group, an ethanesulfonyl group and a p-toluenesulfonyl group), a carbamoyl group having 1 to 12 carbon atoms, preferably 1 to 6 carbon atoms (e.g., an unsubstituted carbamoyl group and a methylcarbamoyl group), a sulfamoyl group having 0 to 12 carbon atoms, preferably 0 to 6 carbon atoms (e.g., an unsubstituted sulfamoyl group and a methylsulfamoyl group), a carbonamido group having 1 to 12 carbon atoms, preferably 1 to 6 carbon atoms (e.g., an acetamido group and a benzamido group), a sulfonamido group having 1 to 12 carbon atoms, preferably 1 to 6 carbon atoms (e.g., a methanesulfonamido group and a benzenesulfonamido group), an acyloxy group having 1 to 12 carbon atoms, preferably 1 to 6 carbon atoms (e.g., an acetyloxy group and a benzoyloxy group), a ureido group having 1 to 12 carbon atoms, preferably 1 to 6 carbon atoms (e.g., an unsubstituted ureido group, a methylureido group and an ethylureido group), an acyl group having 1 to 12 carbon atoms, preferably 1 to 6 carbon atoms (e.g., an acetyl group and a benzoyl group), an aryloxycarbonyl group having 7 to 20 carbon atoms, preferably 7 to 15 carbon atoms (e.g., a phenoxycarbonyl group), a thioureido group having 1 to 12 carbon atoms, preferably 1 to 6 carbon atoms (e.g., an unsubstituted thioureido group and a methylthioureido group), a sulfonyloxy group having 1 to 12 carbon atoms, preferably 1 to 6 carbon atoms (e.g., a methanesulfonyloxy group and a p-toluenesulfonyloxy group), a 5- to 7-membered heterocyclic group containing 1 to 12 carbon atoms, preferably 1 to 6 carbon atoms, and one or more of N, O and S as hetero atoms (e.g., a 1-morpholino group, a 1-piperidino group, a 2-pyridyl group, a 4-pyridyl group, a 2-thienyl group, a 1-pyrazolyl group, a 2-imidazolyl group, a 2-tetrahydrofuryl group and a 2-tetrahydrothienyl group), a cyano group, a nitro group, a sulfonic acid group or a salt thereof such as sodium, potassium or ammonium salt, a halogen atom and a hydroxyl group.

Z' may also be an alkoxycarbonyl group having 2 to 12 carbon atoms, preferably 2 to 6 carbon atoms (e.g., a methoxycarbonyl group and an ethoxycarbonyl group), a carboxylic acid group or a salt thereof.

$R^1$ represents a hydrogen atom, a substituted or unsubstituted alkyl group having 1 to 12 carbon atoms, preferably 1 to 6 carbon atoms (e.g., a methyl group, an ethyl group, a propyl group and a 2-dimethylaminoethyl group), a substituted or unsubstituted aryl group having 6 to 12 carbon atoms, preferably 6 to 12 carbon atoms (e.g., a phenyl group and a 2-methylphenyl group), a substituted or unsubstituted alkenyl group having 2 to 12 carbon atoms, preferably 2 to 6 carbon atoms (e.g., a propenyl group and a 1-methylvinyl group), or a substituted or unsubstituted aralkyl group having 7 to 20 carbon atoms, preferably 7 to 15 carbon atoms (e.g., a benzyl group and a phenethyl group).

X represents a hydrogen atoms, a cation necessary to render the molecule neutral (e.g., a sodium ion, a potassium ion, a zinc ion, a nickel ion, a magnesium ion, a calcium ion, and an ammonium ion), or a precursor thereof (which means a group capable of yielding X=H or an alkali metal ion; for example, an acetyl group, a chloroacetyl group, a cyanoethyl group, and a methanesulfonylethyl group).

Of the compounds represented by general formulae (I), (II), (III) or (IV), the compounds of general formula (I) are preferred. More preferred are the compounds of general formula (I) wherein R represents a straight or branched alkylene group and the compounds of general formula (I) where Z represents a substituted or unsubstituted amino group or a salt thereof. In this case, as well as providing the effects of the present invention, desilvering capability at bleaching can be increased.

Typical examples of compounds represented by general formulae (I), (II), (III) and (IV) are shown below, although the present invention is not limited thereto.

(1)

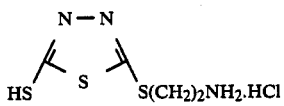

(2)

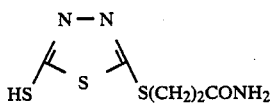

(3)

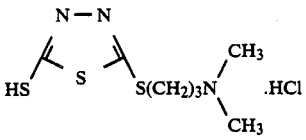

(4)

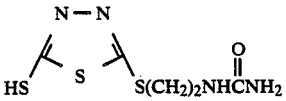

(5)

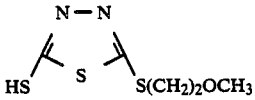

(6)

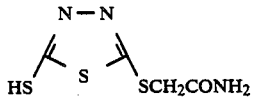

(7)

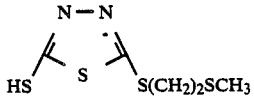

(8)

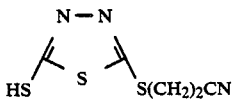

-continued (9)

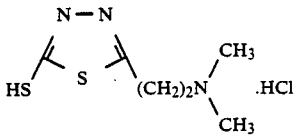

(10)

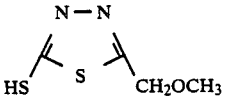

(11)

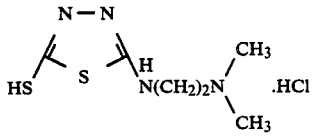

(12)

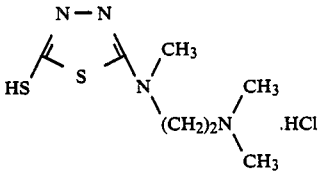

(13)

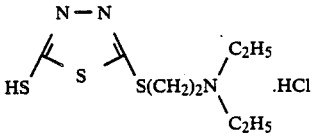

(14)

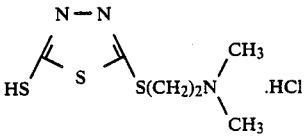

(15)

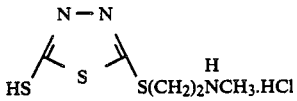

(16)

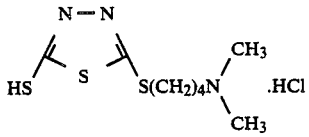

(17)

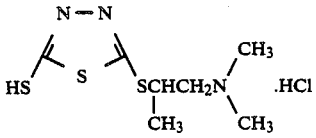

(18)

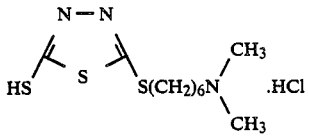

(19)

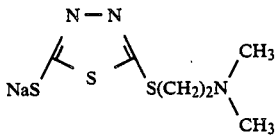

-continued
(20)
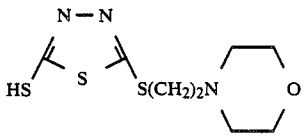
.HCl
(21)
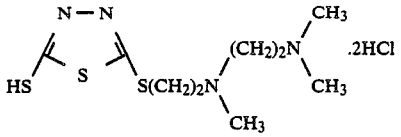
(22)
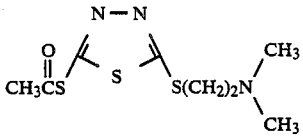
(23)
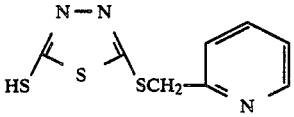
(24)
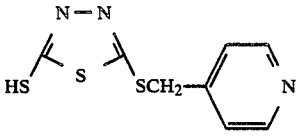
(25)
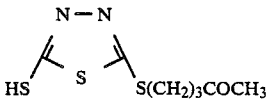
(26)
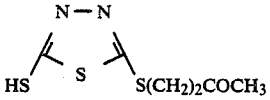
(27)
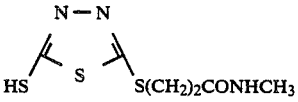
(28)
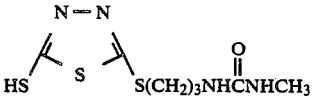
(29)
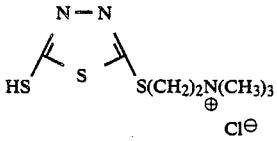
(30)
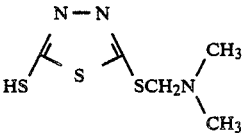
(31)
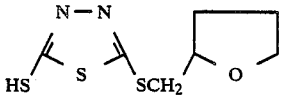
-continued
(32)
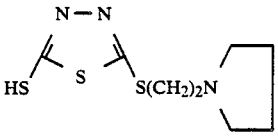
.HCl
(33)
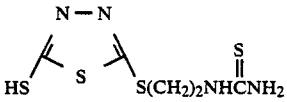
(34)
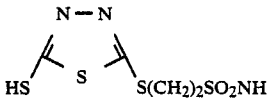
(35)
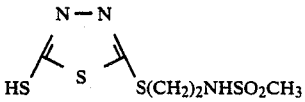
(36)
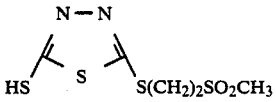
(37)
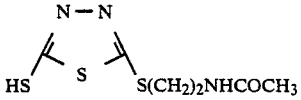
(38)
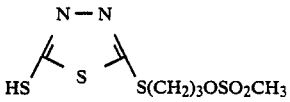
(39)
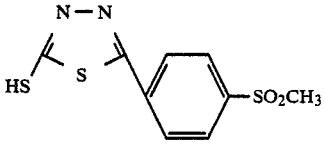
(40)
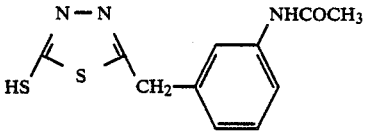
(41)
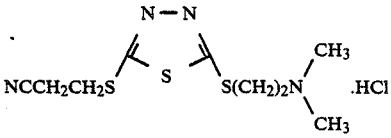
(42)
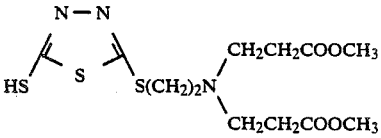

-continued (43)

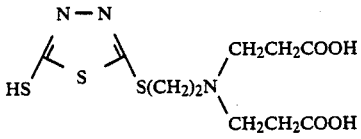

(44)

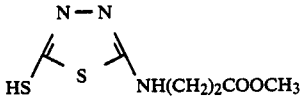

(45)

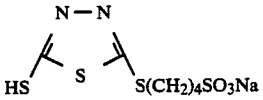

(46)

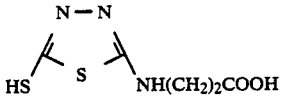

(47)

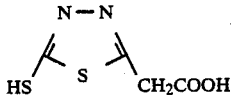

(48)

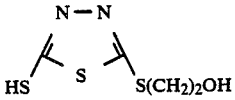

(49)

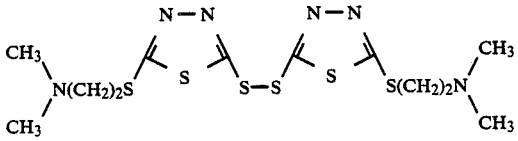

(50)

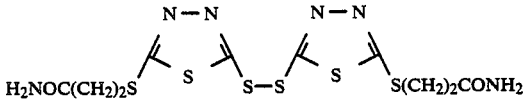

(51)

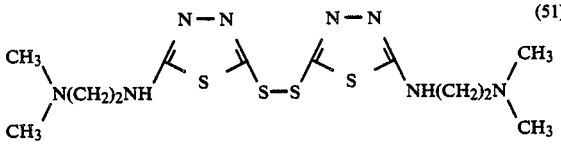

The compounds of general formulae (I), (II), (III) and (IV) which are used in the present invention can be synthesized following the procedure in *Advances in Heterocyclic Chemistry,* Vol. 9, pp. 165–209 (1968).

Typical preparation examples are shown below.

PREPARATION EXAMPLE 1

Preparation of Compound (1)

7.5 g of 2,5-dimercapto-1,3,4-thiadiazole, 5.8 g of 2-aminoethylchloride hydrochloride and 4 g of pyridine were added to 60 ml of n-butanol, and the resulting mixture was refluxed for 2 hours. The reaction mixture was cooled with ice. Crystals precipitated which were filtered off and recrystallized from a methanol/water (1:1 by volume) mixture. Yield: 7.1 g; m.p.=228°–229° C. (decomposed).

PREPARATION EXAMPLE 2

Preparation of Compound (2)

15 g of 2,5-dimercapto-1,3,4-thiadiazole was added to 300 ml of acetone, and then 22 ml of a 28 wt% sodium methoxide solution and 12 g of $\beta$-chloropropionamide were added. In addition, 15 g of sodium iodide was added to the above reaction mixture and the system was heated under relfux for 20 hours. The reaction mixture was cooled, and crystals precipitated which were filtered off and washed with water. These crystals were recrystallized from a dimethylformamide/methanol (1:9 by volume) mixed solvent to yield the desired compound (2). Yield: 12.0 g; m.p.=175°–177° C.

PREPARATION EXAMPLE 3

Preparation of Compound (3)

7.5 g of 2,5-dimercapto-1,3,4-thiadiazole, 7.9 g of 3-dimethylaminopropyl chloride hydrochloride and 4 g of pyridine were added to 60 ml of n-butanol, and the resulting mixture was heated under reflux for 2 hours. The reaction mixture was cooled with ice. Crystals precipitated which were collected by filtration and recrystallized from ethanol. Yield: 11 g; m.p.=149°–152° C.

PREPARATION EXAMPLE 4

Preparation of Compound (4)

15.0 g of 2,5-dimercapto-1,3,4-thiadiazole, and 20 ml of a 28% sodium methoxide solution were added to 100 ml of ethyl alcohol and dissolved therein by heating. Then 13.5 g of 2-chloroethylurea was dropwise added thereto. After the addition, the resulting mixture was heated under reflux for 4 hours. After the reaction, the reaction mixture was poured into 700 ml of ice water. Crystals precipitated which were collected by filtration and recrystallized from methanol. Yield: 16.4 g; m.p.=174°–176° C.

PREPARATION EXAMPLE 5

Preparation of Compound (13)

7.5 g of 2,5-dimercapto-1,3,4-thiadiazole, 8.6 g of 2-diethylaminoethyl chloride hydrochloride and 4 g of pyridine were added to 60 ml of n-butanol, and the resulting mixture was heated under reflux for 2 hours. The reaction mixture was cooled with ice. Crystals precipitated which were collected by filtration and recrystallized from an ethanol/water (1:1 by volume) mixture. Yield: 10.1 g; m.p.=184°–186° C.

PREPARATION EXAMPLE 6

Preparation of Compound (14)

7.5 g of 2,5-dimercapto-1,3,4-thiadiazole, 7.3 g of 2-dimethylaminoethyl chloride hydrochloride and 4 g of pyridine were added to 60 ml of n-butanol, and the resulting mixture was heated under reflux for 2 hours. The reaction mixture was cooled with ice. Crystals precipitated which were collected by filtration and recrystallized from an ethanol. Yield: 7.9 g; m.p.=161°–163° C.

PREPARATION EXAMPLE 7

Preparation of Compounds (42) and (43)

(1) Preparation of 2-[N,N-bis(2-methoxycarbonylethyl-)amino]ethyl chloride hydrochloride 6.1 g of 2-aminoethanol was added to 75 ml of methanol, and 20 ml of methyl acrylate was dropwise added thereto while cooling with ice. After the dropwise addition, the resulting mixture was stirred for 2 hours while cooling with ice and then further stirred for 20 hours at room temperature. The reaction mixture was distilled under reduced pressure. To the oil thus obtained (23 g) was added 100 ml of chloroform, and 8.7 ml of thionyl chloride was dropwise added thereto while cooling with ice. Then the resulting mixture was heated under reflux for 1 hour. The reaction mixture was then distilled under reduced pressure. The residue was recrystallized from an isopropanol/n-hexane (3:1 by volume) mixture. Yield: 21 g; m.p. = 103°-104° C.

(2) Preparation of Compound (42)

7.5 g of 2,5-dimercaptothiadiazole, 14.4 g of 2-[N,N-bis(2-methoxycarbonylethyl)amino]ethyl chloride and 8.1 g of pyridine were added to 80 ml of dioxane, and the resulting mixture was heated under reflux for 2 hours. The reaction mixture was then distilled. The residue was purified by column chromatography (stationary phase: alumina; developing solvent: methanol-/ethyl acetate (1:3 by volume)) to yield compound (42) in a syrup form. Yield: 8.4 g.

(3) Preparation of Compound (43)

7.3 g of the compound (42) was added to 20 ml of a 20 wt% aqueous sodium hydroxide solution and stirred at 50° C. for 2 hours. The reaction solution was neutralized with 35 wt% hydrochloric acid while cooling with ice. The precipitate was removed by filtration and recrystallized from a DMF/ethanol (1:9 by volume) mixture to obtain compound (43). Yield: 3.2 g; m.p. = 188°-189° C.

The compounds of general formulae (I), (II), (III) or (IV) or a mixture thereof are incorporated in at least one silver halide emulsion layer, and/or at least one layer adjacent thereto such as a yellow filter layer, an antihalation layer, an intermediate layer or a protective layer. Most preferably the compound is incorporated in the silver halide emulsion layer.

When the silver halide emulsion layer is composed of two or more unit emulsion layers exhibiting the same color sensitivity, it is preferred that the compound be incorporated in the unit silver halide emulsion layer having the lowest sensitivity among such unit emulsion layers.

The amount of the compound of general formula (I), (II), (III) or (IV) or a mixture thereof used is usually $1\times10^{-1}$ to $1\times10^{-5}$ mol, preferably $2\times10^{-2}$ to $2\times10^{-4}$ mol per mol of silver halide present in the layer or layers in which the compound(s) is or are contained, although it varies with the properties and purpose or end use of the silver halide color reversal light-sensitive material in which the compound is incorporated or with a developing method.

In incorporating the compound of general formula (I), (II), (III) or (IV) or a mixture thereof is a light-sensitive material, the compound is first dissolved in solvents commonly used in photographic materials, such as water, methanol, ethanol, propanol, or fluorinated alcohols, and then added to a hydrophilic colloid. When the compound is incorporated in a silver halide emulsion layer, it may be incorporated at any time depending on the purpose or end use, for example, during formation of silver halide particles, at the time of physical ripening, just before chemical sensitization, during chemical sensitization, after chemical sensitization or during preparation of a coating solution.

The present invention can be applied to any of a color reversal film (inner type and outer type), a color reversal paper and so forth.

The term "color reversal light-sensitive material" as used herein means a color photographic material which is, as described in T. H. James ed., *The Theory of the Photographic Process,* 4th ed., page 336, published by Macmillan Corp., (1977), processed by the following steps:

a first development to conduct black-and-white development, a step to activate silver halide not developed at the first development by light exposure or a chemical method, thereby making it developable, a color development carried out in the presence of couplers, a bleaching step to convert developed silver into silver halide, and a fixing step to dissolve and remove the silver halide.

The bleaching and fixing steps can be replaced by a blixing step.

The silver halide emulsion which is used in the present invention is of the negative type.

As the silver halide used in the photographic emulsion layers of the photographic material of the present invention, any of silver bromide, silver iodobromide, silver iodochlorobromide, silver chlorobromide and silver chloride can be used. Preferred examples are silver iodobromide and silver iodochlorobromide containing not more than about 30 mol% of silver iodide. Particularly preferred is silver iodobromide containing about 0.5 to 10 mol% of silver iodide.

Silver halide particles in the photographic emulsion may be so-called regular particles having a regular crystal form such as cubic, octahedral and tetradecahedral, or particles having an irregular crystal form such as spherical, or particles having a composite crystal form. In addition, a mixture of particles having various crystal forms may be used.

Silver halide particles may be finely divided particles having a diameter of not more than about 0.1 micron or larger sized particles having a projected area based diameter as large as about 10 microns. A monodispersed emulsion having a narrow size distribution or a polydispersed emulsion having a broad size distribution can be used.

Silver halide photographic emulsions which can be used in the present invention can be prepared by known techniques such as the methods described in *Research Disclosure,* Vol. 176, No. 17643 (December 1978). pp. 22-23, "I. Emulsion Preparation and Types", and ibid. Vol. 187, No. 18716 (November 1979), page 648.

Photographic emulsions which are used in the present invention can be prepared by the methods described in, for example, P. Glafkides, *Chimie et Physique Photographique,* Paul Montel (1967), G. F. Duffin, *Photographic Emulsion Chemistry,* Focal Press (1966), and V. L. Zelikman et al., *Making and Coating of Photographic Emulsions,* Focal Press (1964). That is, any of an acid method, a neutral method, an ammonia method and so forth can be employed. In reacting a soluble silver salt and a soluble halide, any of a double jet method, a single jet method, a combination thereof and so forth can be employed. In addition, a method where particles are formed in the presence of an excess of silver ions (the so-called reverse mixing method) can be employed. As an embodiment of the double jet method, a method wherein the pAg in the liquid where the silver halide is formed is maintained constant, i.e., a so-called controlled double jet method, can be employed. In accordance with this method, a silver halide emulsion in which the crystal form is regular and the particle size is nearly uniform can be obtained.

Physical ripening can be carried out in the presence of known silver halide solvents such as ammonia, potassium rhodanide, and thioethers and thione compounds as described in U.S. Pat. No. 3,271,157, Japanese Patent Application (OPI) Nos. 12360/76, 82408/78, 144319/78, 100717/79 and 155828/79. In accordance with this method, a silver halide emulsion in which the crystal form is regular and the particle size distribution is nearly uniform can be obtained.

The aforementioned silver halide emulsion containing regular particles can be prepared by controlling the pAg and pH during the process of formation of the particles. Details are described in, for example, *Photographic Science and Engineering,* Vol. 6, pp. 159–165 (1962), *Journal of Photographic Science,* Vol. 12, pp. 242–251 (1964), U.S. Pat. No. 3,655,394 and British Pat. No. 1,413,748.

A typical example of a monodispersed emulsion is an emulsion in which the silver halide particles have an average particle diameter of more than about 0.1 micron and at least 95 wt% of the particles are within ±40% of the average particle diameter. An emulsion in which the average particle diameter is 0.25 to 2 microns and at least 95 wt% or 95 numerical % of the silver halide particles are controlled within ±20% of the average particle diameter can also be used in the present invention. A method of preparation of such emulsions is described in U.S. Pat. Nos. 3,574,628 and 3,655,394 and British Pat. No. 1,413,748. In addition, monodispersed emulsions as described in Japanese Patent Application (OPI) Nos. 8600/73, 39027/76, 83097/76, 137133/78, 48521/79, 99419/79, 37635/83, and 49938/83 can be preferably used in the present invention.

Tabular particles having an aspect ratio of not less than 5 can be used in the present invention. These tabular particles can be prepared in a simplified manner by the methods described, for example, in Gutoff, *Photographic Science and Engineering,* Vol. 14, pp. 248–257 (1970), U.S. Pat. Nos. 4,434,226, 4,414,310, 4,433,048 and 4,439,520 and British Pat. No. 2,112,157. These tabular particles are used with attendant advantages such as an increase in covering power and an increase in color sensitization efficiency due to sensitizing dyes. They are described in detail in the above referenced U.S. Pat. No. 4,434,226.

The crystal structure of the silver halide may be uniform, or may be such that the halogen composition is different between the inside portion and the surface layer of the silver halide grains, or may have a laminar structure. These emulsion particles are described in British Pat. No. 1,027,146, U.S. Pat. Nos. 3,505,068 and 4,444,877 and Japanese Patent Application (OPI) No. 143331/85, etc. Silver halides having varied compositions which are joined together by epitaxial junction may be used, or silver halides joined to compounds other than silver halide may be used. Such emulsion particles are described, for example, in U.S. Pat. Nos. 4,094,684, 4,142,900 and 4,459,353, British Pat. No. 2,038,702, U.S. Pat. Nos. 4,439,622, 4,395,478, 4,433,501, 4,463,087, 3,656,962 and 3,852,067, and Japanese Patent Application (OPI) No. 162540/84.

In the course of the formation of silver halide particles and physical ripening, cadmium salts, zinc salts, thallium salts, iridium salts or complex salts thereof, rhodium salts or complex salts thereof, iron salts or complex salts thereof, and the like may be present.

The emulsion may be of the surface latent image type where a latent image is formed mainly on the surface thereof, or may be of the internal latent image type where a latent image is formed in the inside of the particles.

To remove a soluble silver salt from the emulsion before or after physical ripening, a noodle water washing method, a flocculation precipitation method, an ultrafiltration, and so forth can be employed.

The emulsion that is used in the present invention is usually subjected to physical ripening, chemical ripening and spectral sensitization. Additives used for these processes are described in the aforementioned references and *Research Disclosure,* No. 17643 (December 1978) and No. 18716 (November 1979). The type of the additive and the pages at which disclosure regarding the additive appears are shown in the Table below.

Known photographic additives which can be used in the present invention are also described in the above references, and the type of the additive and the pages at which disclosure regarding the additive appears are shown in the Table below.

TABLE

| Type of Additive | RD17643* | RD18716* |
|---|---|---|
| 1. Chemical sensitizing agent | p. 23 | p. 648, right column |
| 2. Sensitivity increasing agent | p. 23 | p. 648, right column |
| 3. Spectral sensitizing agent Supersensitizing agent | pp. 23–24 | p. 648, right column to p. 649, right column |
| 4. Whitening agent | p. 24 | |
| 5. Antifoggant and stabilizer | pp. 24–25 | p. 649, right column |
| 6. Light absorbing agent, filter dye, ultraviolet absorber | pp. 25–26 | p. 649, right column to p. 650, left column |
| 7. Strain preventing agent | p. 25, right column | p. 650, left column to right column |
| 8. Dye image stabilizer | p. 25 | |
| 9. Hardening agent | p. 26 | p. 651, left column |
| 10. Binder | p. 26 | p. 651, left column |
| 11. Plasticizer, lubricant | p. 27 | p. 650, right column |
| 12. Coating aid, surface active agent | pp. 26–27 | p. 650, right column |
| 13. Antistatic agent | p. 27 | p. 650, right column |

*Research Disclosure

Various color couplers can be used in the present invention. Representative examples of the color couplers are described in the patents listed in the aforementioned reference, *Research Disclosure,* No. 17643, Clauses VII-C to G. As dye-forming couplers, couplers producing three primary colors (i.e., yellow, magenta and cyan) per the subtractive method through color development are important. As representative examples of hydrophobic, 4-equivalent or 2-equivalent couplers which are diffusion resistant, in addition to the couplers described in the patents listed in the aforementioned reference, *Research Disclosure,* No. 17643, Clauses VII-C and D, the following are preferably used in the present invention.

Typical examples of yellow couplers which can be used in the present invention are hydrophobic acylacetamide based couplers containing a ballast group. Representative examples of such couplers are described, for example, in U.S. Pat. Nos. 2,407,210, 2,875,057 and 3,265,506. In the present invention, it is preferred to use 2-equivalent yellow couplers. Typical examples of such yellow couplers are oxygen atom-releasing type yellow couplers as described in U.S. Pat. Nos. 3,408,194, 3,447,928, 3,933,501 and 4,022,620, and nitrogen atom-releasing type yellow couplers as described in Japanese Patent Publication No. 10739/83, U.S. Pat. Nos. 4,401,752, 4,326,024, *Research Disclosure,* No. 18053 (April 1979), British Pat. No. 1,425,020, and West German Patent Application (OLS) Nos. 2,219,917, 2,261,361, 2,329,587 and 2,433,812. α-Pivaloylacetanilide based couplers produce dyes which are excellent in fastness, particularly light fastness. On the other hand, α-benzoylacetanilide based couplers provide a high color density.

As magenta couplers, couplers which are hydrophobic and have a ballast group, such as indazolone- or cyanoacetyl-based couplers, preferably 5-pyrazolone- and pyrazoloazole-based couplers, are typically used. 5-Pyrazolone-based couplers which are substituted with an arylamino group or acylamino group in the 3-position are preferred form the standpoints of the hue of the colored dye and color density. Typical examples are described in U.S. Pat. Nos. 2,311,082, 2,343,703, 2,600,788, 2,908,573, 3,062,653, 3,152,896 and 3,936,015. As releasing groups of 2-equivalent 5-pyrazolone-based couplers, nitrogen atom releasing groups and an arylthio group as described in U.S. Pat. No. 4,351,897 are particularly preferred. 5-Pyrazolone-based couplers having a ballast group as described in European Patent No. 73,636 provide high color density. As pyrazoloazole-based couplers, pyrazolobenzimidazoles as described in U.S. Pat. No. 3,061,432, preferably pyrazolo[5,1-c][1,2,4]triazoles, hydrotetrazoles are described in *Research Disclosure,* No. 24220 (June 1984) and Japanese Patent Application (OPI) No. 33552/85, and pyrazolopyrazoles as described in *Research Disclosure,* No. 24230 (June 1984) and Japanese Patent Application (OPI) No. 43659/85 are illustrative. In view of the decreased yellow sub-absorption of the colored dye formed and light fastness, imidazo[1,2-b]pyrazoles as described in U.S. Pat. No. 4,500,630 are preferred, and pyrazolo[1,5-b][1,2,4]triazole are particularly preferred.

Cyan couplers which can be used in the present invention include hydrophobic, anti-diffusing naphthol- and phenol-based couplers. Typical examples are naphthol-based couplers as described in U.S. Pat. No. 2,474,293, preferably 2-equivalent naphthol-based couplers of the oxygen atom releasing type as described in U.S. Pat. Nos. 4,052,212, 4,146,396, 4,228,233 and 4,296,200. Representative examples of phenol-based couplers are described in U.S. Pat. Nos. 2,369,929, 2,801,171, 2,772,162 and 2,895,826.

Cyan couplers which are resistant to humidity and temperature are preferably used in the present invention. Typical examples of such couplers are phenol-based cyan couplers having an alkyl group (having two or more carbon atoms) in the meta-position of the phenol nucleus as described in U.S. Pat. No. 3,772,002, 2,5-diacylamino substituted phenol-based couplers as described in U.S. Pat. Nos. 2,772,162, 3,758,308, 4,126,396, 4,334,011 and 4,327,173, West German Patent Application (OLS) No. 3,329,729 and European Pat. No. 121,365, and phenol-based couplers having a phenylureido group in the 2-position and an acylamino group in the 5-position as described in U.S. Pat. Nos. 3,446,622, 4,333,999, 4,451,559, and 4,427,767.

In order to correct unnecessary or undesired absorption of the dyes formed, it is preferred to apply masking to a color negative light-sensitive material for camera use by using a colored coupler in combination. Typical examples are yellow colored magenta couplers as described in U.S. Pat. No. 4,163,670 and Japanese Patent Publication No. 39413/82, and magenta colored cyan couplers as described in U.S. Pat. Nos. 4,004,929 and 4,138,258 and British Pat. No. 1,146,368. Other useful colored couplers are described in the aforementioned reference, *Research Disclosure,* No. 17643, Clause VII-G.

Granularity can be improved by using an combination those couplers capable of producing colored dyes having suitable diffusibility. In connection with such couplers, representative examples of magenta couplers are described in U.S. Pat. No. 4,366,237 and British Pat. No. 2,125,570, and representative examples of yellow, magenta and cyan couplers are described in European Pat. No. 96,570 and West German Patent Application (OLS) No. 3,234,533.

The aforementioned dye forming couplers may be in the form of dimers or higher polymers. Typical examples of polymerized dye forming couplers are described in U.S. Pat. Nos. 3,451,820 and 4,080,211. Representative examples polymerized magenta couplers are described in British Pat. No. 2,102,173 and U.S. Pat. No. 4,367,282.

Couplers releasing a photographically useful groups upon coupling are also preferably used in the present invention. Of DIR couplers releasing a development inhibitor, couplers described in the patents listed in the aforementioned reference, *Research Disclosure,* No. 17643, Clauses VII-F are useful.

Preferably used in combination with the present invention are couplers of the developer deactivating type as described in Japanese Patent Application (OPI) No. 151944/82; couplers of the timing type as described in U.S. Pat. No. 4,248,962 and Japanese Patent Application (OPI) No. 154234/82; couplers of the type as described in Japanese Patent Application (OPI) No. 184248/85. Particularly preferred are DIR couplers of the developer deactivating type as described in Japanese Patent Application (OPI) Nos. 151944/82, 217932/83, Japanese Patent Application (OPI) Nos. 218644/85, 225148/85, 225156/85, 233650/85, and DIR couplers of the reaction type as described in Japanese Patent Application (OPI) No. 184248/85.

Couplers which are used in the present invention can be incorporated in the light-sensitive material by various known dispersion methods such as a solid dispersion method, an alkali dispersion method, preferably a latex dispersion method, and more preferably an oil-in-water dispersion method. In the oil-in-water dispersion method, a coupler is dissolved in a high boiling point organic solvent having a boiling point of not less than 175° C. such as dibutyl phthalate, bis(2-ethylhexyl)phthalate, triphenyl phosphate, tricresyl phosphate, N,N-dimethyllaurylamide, etc. and/or a so-called auxiliary solvent having a low boiling point such as ethyl acetate, methyl ethyl ketone, cyclohexanone, N,N-dimethylformamide, etc., and then typically finely dispersed in an aqueous medium such as water or an aqueous gelatin solution in the presence of one or more surface active agents. Examples of such high boiling point organic solvents are described, for example, in U.S. Pat. No. 2,322,027. In this dispersion, phase conversion may be present. If desired or necessary, coating may be conducted after removing or decreasing the auxiliary solvent by techniques such as distillation, noodle water washing and ultrafiltration.

The process and effect of the latex dispersion method, and representative examples of latexes for impregnation are described, for example, in U.S. Pat. No. 4,199,363 and West German Patent Application (OLS) Nos. 2,541,274 and 2,541,230.

The light-sensitive material of the present invention may contain, as anti-color foggants and color mixing preventing agents, hydroquinone derivatives, aminophenol derivatives, amines, gallic acid derivatives, catechol derivatives, ascorbic acid derivatives, non-color forming couplers, and sulfonamidophenol derivatives.

In the light-sensitive material of the present invention, various fading preventing agents can be used. Typical examples of such organic fading preventing agents are hydroquinones, 6-hydroxychromans, 5-hydroxycumaranes, spirochromans, p-alkoxyphenols, hindered phenols containing bisphenols in the center thereof, gallic acid derivatives, methylenedioxybenzenes, aminophenols, hindered amines and their ether or ester derivatives in which the phenolic hydroxyl group is silylated or alkylated. In addition, metal complexes such as a (bis-salicylaldoximato) nickel complex and a (bis-N,N-dialkyldithiocarbamido) nickel complex can be used.

The present invention is applicable to a multilayer natural color photographic material comprising a support and at least one red-sensitive emulsion layer, at least one green-sensitive emulsion layer and at least one blue-sensitive emulsion layer on the support. The order in which the above emulsions are provided is not critical and can be determined appropriately depending on the purpose of use.

Preferred layer arrangements are such that a red-sensitive emulsion layer, a green-sensitive emulsion layer and a blue-sensitive emulsion layer are provided on a support in this sequence, or such that a blue-sensitive emulsion layer, a red-sensitive emulsion layer and a green-sensitive emulsion layer are provided on a support in this sequence. The foregoing emulsion may each be composed of two or more unit emulsion layers having different sensitivities, and a light-insensitive layer may be present between two or more unit emulsion layers having the same spectral sensitivity. Usually a cyan-forming coupler is incorporated in the red-sensitive emulsion layer; a magenta-forming coupler, in the green-sensitive emulsion layer; and a yellow-forming coupler, in the blue-sensitive emulsion layer. In same cases, different combinations can be used.

In the light-sensitive material of the present invention, it is preferred that as well as the aforementioned silver halide emulsion layer, auxiliary layers such as a protective layer, an intermediate layer, a filter layer, an anti-halation layer, and a back layer be appropriately provided, depending on the purpose of use.

In the photographic material of the present invention, photographic emulsion layers and other layers are coated on a support commonly used in photographic materials, such as a flexible support (e.g., a plastic film, paper, and cloth) and a rigid support (e.g., glass, porcelain and metal). Useful examples of such flexible supports are films of cellulose derivatives (e.g., cellulose nitrate, cellulose acetate and cellulose acetate butyrate), or synthetic polymers (e.g., polystyrene, polyvinyl chloride, polyethylene terephthalate and polycarbonate), and paper laminated or coated with a baryta layer or an -olefin polymer(s)) (e.g., polyethylene, polypropylene and an ethylene/butene copolymer). The support may be colored with dyes or pigments. For the purpose of light shielding, the support may be colored black. The surface of the support is usually subjected to an undercoating treatment for the purpose of strengthening adhesion to the photographic emulsion layer and so forth. The support surface may be subjected to treatments such as glow discharge, corona discharge, irradiation with ultraviolet rays and flame treatment before or after the undercoating treatment.

In coating hydrophilic colloid layers such as the photographic emulsion layer, various known coating methods such as dip coating, roller coating, curtain coating and extrusion coating can be employed. If necessary, a plurality of layers may be coated by coating methods as described in U.S. Pat. Nos. 2,681,294, 2,761,791, 3,526,528 and 3,508,947.

The color photographic material of the present invention can be developed by conventional methods as described in the aforementioned references *Research Disclosure,* No. 17643, pp. 28–29 and *Research Disclosure,* No. 18716, page 651, left column to right column. The color photographic material of the present invention is usually subjected to water washing or stabilization after development, bleach-fixing or fixing.

In the washing step, countercurrent washing using two or more vessels are usually used to save water. A typical example of the stabilization is a multi-stage countercurrent stabilization as described in Japanese Patent Application (OPI) No. 8543/82. E.g., 2 to 9 vessels (countercurrent baths) are generally needed. To the stabilization bath are added various compounds for the purpose of stabilizing an image. Typical examples of such compounds are various buffers for adjusting the film pH (for example, to a pH of 3 to 8), such as boric acid salts, metaboric acid salts, borax, phosphoric acid salts, carbonic acids salts, potassium hydroxide, sodium hydroxide, ammonia water, monocarboxylic acid(s), dicarboxylic acid(s) and polycarboxylic acid(s), which can be used in combination with one another, and formalin. In addition, if desired or necessary, a hard water softening agent (e.g., inorganic phosphoric acid, aminopolycarboxylic acid, aminopolyphosphinic acid and phosphonocarboxylic acid), a bactericide (e.g., benzoisothiazolinones, isothiazolones, 4-thiazolinebenzimidazoles, and halogenated phenols), a surface active agent, a fluorescent brightener, and a hardener, and other additives may be used. Two or more of such compounds which are used for different purposes may be used in combination.

Preferably, as film pH-adjusting agents used after processing, various ammonium salts such as ammonium chloride, ammonium nitrate, ammonium sulfate, ammonium phosphate, ammonium sulfite, and ammonium thiosulfate are added.

The present invention is described below in greater detail with reference to the following examples although the present invention is not limited thereto.

Unless otherwise indicated, all percents used are by weight.

EXAMPLE 1

A triacetate film base was coated with the following first to twelfth layers in the order shown below to prepare Sample 101.

First Layer: Antihalation layer (gelatin layer containing 0.25 g/m$^2$ of black colloid silver, 2,3 μm thick)

Second Layer: Gelatin Intermediate Layer 2,5-Di-tert-octylhydroquinone was dissolved in 100 ml of dibutyl phthalate and 100 ml of ethyl acetate and then stirred at high speed in admixture with 1 kg of a 10% aqueous gelatin solution to prepare an emulsion. A mixture of 2 kg of the emulsion as prepared above and 1 kg of a finely divided silver halide particle emulsion (particle size: 0.06 m; 1 mol% silver iodobromide emulsion) which had not been subjected to chemical sensitization was mixed with 1.5 kg of a 10% gelatin solution and the resulting mixture was then coated in a dry film thickness of 2 μm (amount of silver coated: 0.4 g/m$^2$).

Third Layer: Low Sensitivity Red-Sensitive Emulsion Layer 100 g of 2-(Heptafluorobutyramido)-5-{2'-(2'',4''-di-tert-amylphenoxy)butyramido}phenol as a cyan coupler was dissolved in a mixed solvent of 100 ml of tricresyl phosphate and 100 ml of ethyl acetate and then stirred at high speed in admixture with 1 kg of a 10% aqueous gelatin solution to prepare an emulsion. 500 g of this emulsion was mixed with 1 kg of a red-sensitive silver iodobromide emulsion (containing 70 g of silver and 60 g of gelatin; iodine content: 3.5 mol%; average particle size: 0.3 μm). The resulting mixture was coated in a dry film thickness of 1 μm (amount of silver coated: 0.5 g/m$^2$).

Fourth Layer: High Sensitivity Emulsion Layer 100 g of 2-(Heptafluorobutyramido)-5-{2'-(2'',4''-di-tert-amylphenoxy)butyramido}phenol as a cyan coupler was dissolved in a mixed solvent of 100 ml of tricresyl phosphate and 100 ml of ethyl acetate and then stirred at high speed in admixture with 1 kg of a 10% aqueous gelatin solution to prepare an emulsion. 1,000 g of this emulsion was mixed with a red-sensitive silver iodobromide emulsion (containing 70 g of silver and 60 g of gelatin; iodine content: 2.5 mol%; average particle size: 0.3 μm). The resulting mixture was coated in a dry film thickness of 2.5 μm (amount of silver coated: 0.7 g/m$^2$).

Fifth Layer: Intermediate Layer 2,5-Di-tert-octylhydroquinone (80 mg/m$^2$) was dissolved in a mixed solvent of 100 ml of dibutyl phthalate and 100 ml of ethyl acetate and then stirred at high speed in admixture with 1 kg of a 10% aqueous gelatin solution to prepare an emulsion. 1 kg of this emulsion was mixed with 1 kg of a 10% aqueous gelatin solution. The resulting mixture was coated in a dry film thickness of 1 μm.

Sixty Layer: Low Sensitivity Green-Sensitive Emulsion Layer

An emulsion was prepared in the same manner as in the preparation of the emulsion of the third layer except that 1-(2,4,6-trichlorophenyl)-3-{3-(2,4-di-tert-amylphenoxyacetamido)benzamido}-5-pyrazolone as a magenta coupler was used in the place of the cyan coupler. 300 g of this emulsion was mixed with 1 kg of a green-sensitive silver iodobromide emulsion (containing 70 g of silver and 60 g of gelatin; iodine content: 3.5 mol%; average particle size: 0.3 μm) and the resulting mixture was coated in a dry film thickness of 1.3 μm (amount of silver coated: 0.7 g/m$^2$).

Seventh Layer: High Sensitivity Green-Sensitive Emulsion Layer

An emulsion was prepared in the same manner as in the preparation of the emulsion of the third layer except that 1-(2,4,6-trichlorophenyl)-3-{3-(2,4-di-tert-amylphenoxyacetamido)benzamido}-5-pyrazole as a magenta coupler was used in place of the cyan coupler. 1,000 g of the emulsion was mixed with a 1 kg of a green-sensitive silver iodobromide emulsion (containing 870 g of silver and 60 g of gelatin; iodine content: 2.5 mol%; average particle size: 0.3 μm) and the resulting mixture was coated in a dry film thickness of 3.5 μm (amount of silver coated: 0.8 g/m$^2$).

Eighth Layer: Yellow Filter Layer

An emulsion containing yellow colloid silver was coated in a dry film thickness of 1 μm (amount of silver coated: 0.098 g/m$^2$).

Ninth Layer: Low Sensitivity Blue-Sensitive Emulsion Layer

An emulsion was prepared in the same manner as in the preparation of the emulsion of the third layer except that α-(pivaloyl)-α-(1-benzyl-5-ethoxy-3-hydantoinyl)-2-chloro-5-dodecyloxycarbonylacetanilide as a yellow coupler was used in place of the cyan coupler. 1,000 g of the emulsion was mixed with 1 kg of a blue-sensitive silver iodobromide emulsion (containing 70 g of silver and 60 g of gelatin; iodine content: 3.5 mol%; average particle size: 0.6 μm) and the resulting mixture was coated in a dry film thickness of 1.5 μm (amount of silver coated: 0.6 g/m$^2$).

Tenth Layer: High Sensitivity Blue-Sensitive Emulsion Layer

An emulsion was prepared in the same manner as in the preparation of the emulsion of the third layer except that α-(pivaloyl)-α-(1-benzyl-5-ethoxy-3-hydantoinyl)-2-chloro-5-dodecyloxycarbonylacetanilide as a yellow coupler was used in place of the cyan coupler. 1,000 g of the emulsion was mixed with 1 kg of the aforementioned blue-sensitive silver iodobromide emulsion (containing 70 g of silver and 60 g of gelatin; iodine content: 2.5 mol%; average particle size: 0.6 μm) and the resulting mixture was coated in a dry film thickness of 3 μm (amount of silver coated: 1.1 g/m$^2$).

Eleventh Layer: Second Protective Layer 1 kg of an emulsion of a conventional ultraviolet absorber was mixed with a 10% aqueous gelatin solution and then coated in a dry film thickness of 2 μm.

Ultraviolet Absorber:

2-(2-Hydroxy-5-t-butyl)phenylbenzotriazole: 0.08 g/m$^2$

Dodecyl 5-(N,N-dimethyl)amino-2-phenylsulfonyl-2,4-pentan-dienoate: 0.3 g/m$^2$

Twelfth Layer: First Protective Layer

A 10% aqueous gelatin solution containing a conventional surface-fogged finely divided particle emulsion (particle size: 0.06 μm; 1 mol% silver iodobromide emulsion) was coated in such a manner that the amount of silver coated was 0.1 g/m$^2$ and the dry film thickness of 0.8 μm.

Into each layer there were incorporated a gelatin hardener and a surface active agent.

Gelatin Hardener:

1,2-Bis(vinylsulfonylacetamido)ethane: 0.4 g/m$^2$

Preparation of Samples 102 to 115

Samples 102 to 115 were prepared in the same manner as in the preparation of Sample 101 except that in the third, sixth and ninth layers the compounds shown in Table 1 were added in the amounts shown in Table 1.

In each of Samples 101 to 115, red wedge exposure, green wedge exposure and blue wedge exposure were applied at one part, and, at another part, white wedge exposure (red+green+blue light) was applied.

The exposure amounts of the red, green and blue light at the time of the white light exposure were equal to the amounts in red exposure, green exposure and blue exposure, respectively.

The sample thus exposed was processed as follows:

Processing Steps

| Processing Steps | Time (min) | Temperature (°C.) |
|---|---|---|
| First Development | 6 | 38 |
| Water Washing | 2 | " |
| Reversal | 2 | " |
| Color Development | 6 | " |
| Adjustment | 2 | " |
| Bleaching | 6 | " |
| Fixing | 4 | " |
| Water Washing | 4 | " |
| Stabilization | 1 | room temperature |

The composition of each of the processing solutions used was as follows:

| | |
|---|---|
| First Developer | |
| Water | 700 ml |
| Pentasodium nitrilo-N,N,N—trimethylene-phosphonate | 3 g |
| Sodium sulfite | 20 g |
| Hydroquinone monosulfonate | 30 g |
| Sodium carbonate (monohydrate) | 30 g |
| 1-Phenyl-4-methyl-4-hydroxymethyl-3-pyrazolidone | 2 g |
| Potassium bromide | 2.5 g |
| Potassium thiocyanate | 1.2 g |
| Potassium iodide (0.1% aqueous solution) | 2 ml |
| Water to make | 1,000 ml |
| Reversal Solution | |
| Water | 700 ml |
| Pentasodium nitrilo-N,N,N—trimethylene-phosphonate | 3 g |
| Stannous chloride (dihydrate) | 1 g |
| p-Aminophenol | 0.1 g |
| Sodium hydroxide | 8 g |
| Glacial acetic acid | 15 ml |
| Water to make | 1,000 ml |

-continued

| | |
|---|---|
| Color Developer | |
| Water | 700 ml |
| Pentasodium nitrilo-N,N,N—trimethylene-phosphonate | 3 g |
| Sodium sulfite | 7 g |
| Sodium triphosphate (12 hydrate) | 36 g |
| Potassium bromide | 1 g |
| Potassium iodide (0.1% aqueous solution) | 90 ml |
| Sodium hydroxide | 3 g |
| Citrazinic acid | 1.5 g |
| N—Ethyl-N—(β-methanesulfonamidoethyl)-3-methyl-4-aminoaniline sulfate | 11 g |
| Ethylenediamine | 3 g |
| Water to make | 1,000 ml |
| Adjusting Solution | |
| Water | 700 ml |
| Sodium sulfite | 12 g |
| Sodium ethylenediaminetetraacetate (dihydrate) | 8 g |
| Thioglycerol | 0.4 ml |
| Glacial acetic acid | 3 ml |
| Water to make | 1,000 ml |
| Bleaching Solution | |
| Water | 800 ml |
| Sodium ethylenediaminetetraacetate (dihydrate) | 2 g |
| Iron (III) ammonium ethylenediamine-tetraacetate (dihydrate) | 120 g |
| Potassium bromide | 100 g |
| Water to make | 1,000 ml |
| Fixing Solution | |
| Water | 800 ml |
| Sodium thiosulfate | 80.0 g |
| Sodium sulfite | 5.0 g |
| Sodium hydrogen sulfite | 5.0 g |
| Water to make | 1,000 ml |
| Stabilizing Solution | |
| Water | 800 ml |
| Formalin (37 wt %) | 5.0 ml |
| Fuji Driwell (surface active agent produced by Fuji Photo Film Co., Ltd.) | 5.0 ml |
| Water to make | 1,000 ml |

By comparison of the cyan density at the area of red light exposure with the cyan density at the area of white light exposure, the exposure amount difference Δlog E at a density of 1.0 was measured.

Also in the case of green light exposure and blue light exposure, Δlog E was measured. p As log E is larger, the interimage effect is greater.

The results are shown in Table 1.

TABLE 1

| Sample No. | Additive | Amount of Additive per mol of Silver (mg) | ΔLog E at Cyan Density of D = 0.1 | ΔLog E at Magenta Density of D = 0.1 | ΔLog E at Yellow Density of D = 0.1 |
|---|---|---|---|---|---|
| 101 | — | — | 0.28 | 0.22 | 0.19 |
| 102 | Compound A | 150 | 0.31 | 0.24 | 0.22 |
| 103 | Compound B | 150 | 0.32 | 0.24 | 0.22 |
| 104 | Compound C | 150 | 0.28 | 0.23 | 0.21 |
| 105 | 4* | 150 | 0.49 | 0.43 | 0.39 |
| 106 | 9 | 150 | 0.50 | 0.42 | 0.37 |
| 107 | 12 | 150 | 0.48 | 0.42 | 0.38 |
| 108 | 14 | 150 | 0.53 | 0.44 | 0.37 |
| 109 | 20 | 150 | 0.47 | 0.40 | 0.35 |
| 110 | 23 | 150 | 0.48 | 0.39 | 0.38 |
| 111 | 26 | 150 | 0.49 | 0.43 | 0.36 |
| 112 | 31 | 150 | 0.46 | 0.41 | 0.37 |
| 113 | 36 | 150 | 0.47 | 0.41 | 0.37 |
| 114 | 44 | 150 | 0.48 | 0.42 | 0.38 |

TABLE 1-continued

| Sample No. | Additive | Amount of Additive per mol of Silver (mg) | ΔLog E at Cyan Density of D = 0.1 | ΔLog E at Magenta Density of D = 0.1 | ΔLog E at Yellow Density of D = 0.1 |
|---|---|---|---|---|---|
| 115 | 49 | 150 | 0.51 | 0.40 | 0.37 |

Note:
Samples 101 to 104: Comparative Examples
Samples 105 to 115: Examples of the Invention
*All Compounds as earlier identified herein.

Compound A

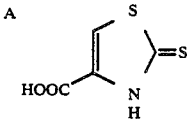

(a compound described in Japanese Patent Publication No. 12677/71)

Compound B

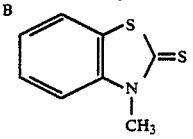

(a compound described in Japanese Patent Publication No. 34169/73)

Compound C

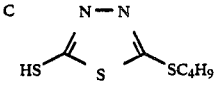

(a compound similar to the compounds of the present invention)

It can be seen from the results of Table 1 that as compared with compounds A and B which have been known to be capable of increasing the interimage effect and compound C which is similar to the compounds of the present invention, the compounds of the present invention provide a greater interimage effect.

EXAMPLE 2

A multilayer color light-sensitive material was prepared by coating the following first layer (lowermost layer) to eleventh layer on a paper support which had been laminated with polyethylene on both sides. The units of amount coated are mg/m$^2$. This material is called Sample 201.

| | |
|---|---|
| Eleventh Layer: Protective Layer | |
| Gelatin | 1,000 mg/m$^2$ |
| Silver chlorobromide emulsion (silver bromide: 2.0 mol %; average particle size: 0.2 μm; amount of silver coated: 10 mg/m$^2$) | |
| Tenth Layer: Ultraviolet ray absorbing agent | |
| Gelatin | 1,500 mg/m$^2$ |
| Ultraviolet absorber *1 | 1,000 mg/m$^2$ |
| Ultraviolet absorber solvent *2 | 300 mg/m$^2$ |
| Color mixing preventing agent *3 | 80 mg/m$^2$ |
| Ninth Layer: High Sensitivity Blue-Sensitivity Layer | |
| Silver iodobromide emulsion (silver iodide: 2.5 mol %; average particle size: 1.0 μm; amount of silver: 200 mg/m$^2$) | |
| Blue sensitizing dye *4 | 2.0 × 10$^{-4}$ mol/mol Ag |
| Gelatin | 1,000 mg/m$^2$ |
| Yellow coupler *5 | 400 mg/m$^2$ |
| Coupler solvent *2 | 100 mg/m$^2$ |
| Eighth Layer: Low Sensitivity Blue-Sensitive Layer | |
| Silver iodobromide emulsion layer (silver iodide: 2.5 mol %; average particle size: 0.5 μm; amount of silver: 150 mg/m$^2$) | |
| Blue sensitivity dye *4 | 2.5 × 10$^{-4}$ mol/mol Ag |
| Gelatin | 500 mg/m$^2$ |
| Yellow coupler *5 | 200 mg/m$^2$ |
| Coupler solvent *2 | 50 mg/m$^2$ |
| Seventh Layer: Yellow Filter Layer | |

-continued

| | |
|---|---|
| Yellow colloidal silver | 200 mg/m$^2$ |
| Gelatin | 1,000 mg/m$^2$ |
| Color mixing preventing agent *6 | 60 mg/m$^2$ |
| Color mixing preventing agent solvent *7 | 240 mg/m$^2$ |
| Sixth Layer: High Sensitivity Green-Sensitive Emulsion Layer | |
| Silver iodobromide emulsion (silver iodide: 3.5 mol %; average particle size: 0.9 μm; amount of silver: 200 mg/m$^2$) | |
| Green sensitizing dye *8 | 4.5 × 10$^{-4}$ mol/mol Ag |
| Gelatin | 700 mg/m$^2$ |
| Magenta coupler *9 | 150 mg/m$^2$ |
| Fading preventing agent A *10 | 50 mg/m$^2$ |
| Fading preventing agent B *11 | 50 mg/m$^2$ |
| Fading preventing agent C *12 | 20 mg/m$^2$ |
| Coupler solvent *13 | 150 mg/m$^2$ |
| Fifth Layer: Low Sensitivity Green-Sensitive layer | |
| Silver iodobromide emulsion (silver iodide: 2.5 mol %; average particle size: 0.4 μm; amount of silver: 200 mg/m$^2$) | |
| The green sensitizing dye, gelatin, magenta coupler, fading preventing agents, coupler solvent, etc., are the same as in the sixth layer. | |
| Fourth Layer: Intermediate Layer | |
| Yellow colloidal silver | 20 mg/m$^2$ |
| Gelatin | 1,000 mg/m$^2$ |
| Color mixing preventing agent *6 | 80 mg/m$^2$ |
| Color mixing preventing agent solvent *7 | 160 mg/m$^2$ |
| Polymer latex (plymethyl methacrylate) | 400 mg/m$^2$ |
| Third Layer: High Sensitivity Red-Sensitive Layer | |
| Silver iodobromide emulsion (silver iodide: 8.0 mol %; average particle size: 0.7 μm; amount of silver: 100 mg/m$^2$) | |
| Red sensitizing dye *15 | 3.5 × 10$^{-4}$ mol/mol Ag |
| Red sensitizing dye *16 | 2.0 × 10$^{-4}$ mol/mol Ag |
| Gelatin | 500 mg/m$^2$ |
| Cyan coupler *17 | 100 mg/m$^2$ |
| Fading preventing agent *18 | 50 mg/m$^2$ |
| Coupler solvent *5, 19 | 20 mg/m$^2$ |
| Second Layer: Low Sensitivity Red-Sensitive Layer | |
| Silver iodobromide emulsion (silver iodide: 3.5 mol %; average particle size: 0.35 μm; amount of silver: 150 mg/m$^2$) | |
| Red sensitizing dye *15 | 5.0 × 10$^{-4}$ mol/ |

-continued

| | |
|---|---|
| Red sensitizing Dye *16 | $3.0 \times 10^{-4}$ mol/mol Ag |
| Gelatin | 1,000 mg/m$^2$ |
| Cyan coupler *17 | 300 mg/m$^2$ |
| Fading preventing agent *18 | 150 mg/m$^2$ |
| Coupler solvent *5, 19 | 60 mg/m$^2$ |
| First Layer: Antihalation Layer | |
| Black colloidal silver | 100 mg/m$^2$ |
| Gelatin | 2,000 mg/m$^2$ |
| Support: | |
| Polyethylene laminated paper (polyethylene in contact with the first layer contains a conventional white pigment (e.g., $TiO_2$) and a conventional bluish dye (e.g., ultramarine). | |

*1: 5-Chloro-2-(2-hydroxy-3-tert-butyl-5-tert-octyl)-phenylbenzotriazole
*2: Trinonyl phosphate
*3: 2,5-Di-sec-octylhydroquinone
*4: Triethylammonium 3-[2-(3-benzylrhodanin-5-ylidene)-3-benzoxazolinyl]propane sulfonate
*5: Y-11: α-Pivaloyl-α-[2,4-dioxo-1-benzyl-5-ethoxy-hydantoin-3-yl)-2-chloro-5-[α-2,4-di-tert-amyl-phenoxy)butanamido]acetanilide
*6: 2,5-Di-tert-octylhydroquinone
*7: o-Cresyl phosphate
*8: 5,5-Diphenyl-9-ethyl-3,3-disulfopropyloxacarbocyanine sodium salt
*9: M-1: 1-(2,4,6-Trichlorophenyl)-3-[2-chloro-5-tetra-decanamido]anilino-2-pyrazolin-5-one
*10: 3,3,3',3'-Tetramethyl-5,6,5',6'-tetrapropoxy-1,1'-bis-spiroindane
*11: Di-[2-hydroxy-3-tert-butyl-5-methylphenyl]methane
*12: 2,5-Di-tert-hexylhydroquinone
*13: Trioctyl phosphate
*14: Polyethyl acrylate
*15: Triethylammonium 3-[2-{2-[3-(sulfonatopropyl)naphtho-[1,2-α]thiazolin-2-ylidenemethyl]-1-butenyl}-3-naphtho[1,2-α]thiazolino]propane sulfonate
*16: 5,5'-Dichloro-3,3'-di(3-sulfobutyl)-9-ethylthiacarbo-cyanine sodium salt
*17: C-13: 2-[α-(2,4-di-tert-amylphenoxy)butanamido]-4,6-dichloro-5-methylphenol
*18: 2-(2-Hydroxy-3-sec-butyl-5-tert-butylphenyl)benzotri-azole
*19: Dioctyl phthalate Samples 202 to 213

Samples 202 to 213 were prepared in the same manner as in the preparation of Sample 201 except that in the second and third layers, the compounds shown in Table 2 were added in the amounts shown in Table 2 to each of the second and third layers.

Samples 214 and 215

Samples 214 and 215 were prepared in the same manner as in the preparation of Sample 201 except that in the second and fourth layers, the compounds shown in Table 2 were added in the amounts shown in Table 2 to each of the second and fourth layers.

For each of Samples 201 to 215, red wedge exposure was applied at one area and at another area, white wedge exposure (red+green+blue light) was applied. The amount of red light exposed at the white exposure was equal to that at the red wedge exposure.

The samples thus exposed were developed as follows.

| Processing Steps | | |
|---|---|---|
| First development (black-and-white development) | 38° C. | 1'15" |
| Water washing | 38° C. | 2'15" |
| Reversal exposure | at least 100 lux | |
| Color development | 38° C. | 1'30" |
| Water washing | 38° C. | 45" |
| Bleach-fixing | 38° C. | 2' |
| Water washing | 38° C. | 2'15" |
| | | total 10' |

| Composition of Processing Solution | |
|---|---|
| First Developer (Black-and-white) | |
| Disodium ethylenediaminetetraacetate (dihydrate) | 3.0 g |
| Sodium hydrogencarbonate | 2.3 g |
| 1-Phenyl-3-pyrazolidone | 0.45 g |
| Anhydrous potassium sulfite | 47 g |
| Hydroquinone | 6 g |
| Potassium carbonate | 25 g |
| Sodium bromide | 1.4 g |
| Potassium iodide (0.1%; aqueous) | 3 ml |
| Diethylene glycol | 20.0 ml |
| Potassium thiocyanate | 1.0 g |
| Water to make | 1,000 ml |
| The pH was adjusted to 10.2 by adding potash soda. | |
| Color Developer | |
| Benzyl alcohol | 12 ml |
| Pentasodium nitrilo-N,N,N—trimethylene-phosphonate | 3.0 g |
| Anhydrous sodium sulfite | 7.5 g |
| Potassium carbonate | 32.0 g |
| Potassium bromide | 0.3 g |
| Potassium iodide (0.1%; aqueous) | 90.0 ml |
| Sodium hydroxide | 2.3 g |
| N—Ethyl-N—(β-methanesulfonamidoethyl)-3-methyl-4-aminoaniline sulfate | 11.0 g |
| Ethylene glycol | 20 ml |
| Ethylenediamine | 3 g |
| Water to make | 1,000 ml (pH = 10.75) |
| Bleach-Fixing Solution | |
| 5-Amino-2-mercapto-1,3,4-thiadiazole | 1.0 g |
| Ammonium bromide | 50.0 g |
| Ammonia water (28%) | 30.0 ml |
| Iron (III) ammonium ethylenediamine-tetraacetate monohydrate | 45 g |
| Disodium ethylenediaminetetraacetate dihydrate | 2 g |
| Anhydrous sodium sulfite | 10 g |
| Ammonium thiosulfate | 160.0 ml |
| Glacial acetic acid | 5.9 ml |
| Water to make | 1,000 ml (pH = 6.7) |

By compasion of the cyan density at the area of red light exposure with the cyan density at the area of white light exposure, the exposure amount different Δlog E at a density of 0.7 was measured.

With regard to sharpness, the MFT value was measured.

The results are shown in Table 2.

TABLE 2

| Sample No. | Additive | Amount of Additive per mol of Silver (mg) | ΔLog E at Cyan Density of D = 0.5 | Sharpness (MTF) Cyan Image (10 c/mm) |
|---|---|---|---|---|
| 201 | — | — | 0.15 | 0.55 |
| 202 | Compound A | 100 | 0.18 | 0.57 |
| 203 | Compound B | 100 | 0.18 | 0.57 |
| 204 | Compound C | 100 | 0.16 | 0.56 |
| 205 | 3* | 100 | 0.30 | 0.64 |
| 206 | 6 | 100 | 0.29 | 0.62 |
| 207 | 8 | 100 | 0.28 | 0.62 |
| 208 | 22 | 100 | 0.28 | 0.63 |
| 209 | 32 | 100 | 0.29 | 0.62 |
| 210 | 38 | 100 | 0.29 | 0.62 |
| 211 | 41 | 100 | 0.27 | 0.62 |
| 212 | 46 | 100 | 0.26 | 0.62 |
| 213 | 50 | 100 | 0.29 | 0.63 |
| 214 | 3 | 100 | 0.24 | 0.62 |

TABLE 2-continued

| Sample No. | Additive | Amount of Additive per mol of Silver (mg) | ΔLog E at Cyan Density of D = 0.5 | Sharpness (MTF) Cyan Image (10 c/mm) |
|---|---|---|---|---|
| 215 | 22 | 100 | 0.22 | 0.61 |

Note:
Samples 201 to 204: Comparative Examples
Samples 205 to 215: Examples of the Invention
*All Compounds as earlier identified herein.

Compound A

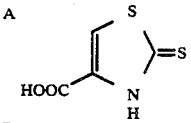

Compound B

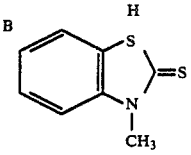

Compound C

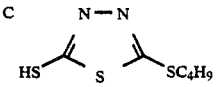

It can be seen from the results that as compared with the comparative examples, the present invention provided an excellent interimage effect and sharpness.

While the invention has been described in detail and with reference to specific embodiments thereof, it will be apparent to one skilled in the art that various changes and modifications can be made therein without departing from the spirit and scope thereof.

What is claimed is:

1. A silver halide color reversal photographic material comprising a support, and at least one blue-sensitive silver halide emulsion layer, at least one green-sensitive silver halide emulsion layer and at least one red-sensitive silver halide emulsion layer on the support, wherein at least one light-sensitive silver halide emulsion layer or at least one layer adjacent thereto contains at least one of the compounds represented by the following general formulae (I), (II), (III) and (IV):

General Formula (I)

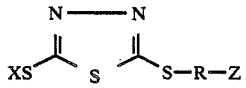

General Formula (II)

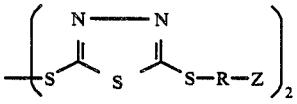

General Formula (III)

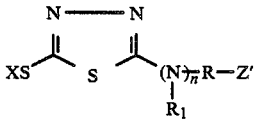

General Formula (IV)

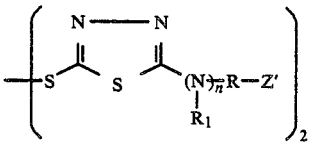

wherein R represents a straight, branched or cyclic alkylene group, a straight or branched alkenylene group, a straight or branched aralkylene group, or an arylene group, $R^1$ represents a hydrogen atom, a substituted or unsubstituted alkyl group, a substituted or unsubstituted alkenyl group, a substituted or unsubstituted aralkyl group, or a substituted or unsubstituted aryl group, Z represents a polar substituent selected from the group consisting of a substituted or unsubstituted amino group or a salt thereof; a quaternary ammoniumyl group, an alkoxy group, an aryloxy group, an alkylthio group, an arylthio group, a heterocyclic oxy group, a heterocyclic thio group, a sulfonyl group, a carbamoyl group, a sulfamoyl group, a carbonamido group, a sulfonamido group, an acyloxy group, a ureido group, an acyl group, an aryloxycarbonyl group, a thioureido group, a sulfonyloxy group, a heterocyclic group, a cyano group, a nitro group, a halogen atom, and a hydroxyl group, and Z' represents a polar substituent selected from the group consisting of a substituted or unsubstituted amino group or a salt thereof; a quaternary ammoniumyl group, an alkoxy group, an aryloxy group, an alkylthio group, an arylthio group, a heterocyclic oxy group, a heterocyclic thio group, a sulfonyl group, a carbamoyl group, a sulfamoyl group, a carbonamido group, a sulfonamido group, an acyloxy group, a ureido group, an acyl group, an aryloxycarbonyl group, a thioureido group, a sulfonyloxy group, a heterocyclic group, a cyano group, a nitro group, a halogen atom, a hydroxyl group, an alkoxycarbonyl group, and a carboxylic acid group or a salt thereof, X represents a hydrogen atom, a cation rendering the molecule neutral or a precursor thereof, n is 0 or 1.

2. The silver halide color reversal photographic material as claimed in claim 1, wherein said at least one light-sensitive silver halide emulsion layer or at least one layer adjacent thereto contains a compound represented by general formula (I).

3. The silver halide color reversal photographic material as claimed in claim 2, wherein R represents a straight or branched alkylene group.

4. The silver halide color reversal photographic material as claimed in claim 1, wherein Z represents a substituted or unsubstituted amino group or a salt thereof.

5. The silver halide color reversal photographic material as claimed in claim 1, wherein said compound is contained in a silver halide emulsion layer or a yellow filter layer, an anti-halation layer, an intermediate layer, or a protective layer, adjacent thereto.

6. The silver halide color reversal photographic material as claimed in claim 1, wherein said at least one light-sensitive silver halide emulsion layer comprises two or more unit emulsion layers having different sensitivities and said compound is contained in the unit emulsion layer having the lowest sensitivity among said two or more unit emulsion layers.

7. The silver halide color reversal photographic material as claimed in claim 5, wherein said adjacent layer is selected from the group consisting of a yellow filter layer, an anti-halation layer, an intermediate layer, and a protective layer.

8. The silver halide color reversal photographic material as claimed in claim 1, wherein said compound is contained in a total amount of $1\times10^{1}$ to $1\times10^{-5}$ mol per mol of silver halide present in the layer or all the layers in which said compound is present.

9. The silver halide color reversal photographic material as claimed in claim 1, wherein said compound is contained in a total amount of $2\times10^{-2}$ to $2\times10^{-4}$ mol per mol of silver halide present in the layer or all the layers in which said compound is present.

10. A method for forming a color photographic image comprising imagewise exposing and developing a silver halide color reversal photographic material as claimed in claim 1.

* * * * *